United States Patent [19]

Stuckel

[11] Patent Number: 4,714,098

[45] Date of Patent: Dec. 22, 1987

[54] BALL INFLATION APPARATUS

[76] Inventor: Robert W. Stuckel, 1385 Howard St., Elk Grove Village, Ill. 60007

[21] Appl. No.: 501,991

[22] Filed: Jun. 8, 1983

[51] Int. Cl.[4] ..... A63B 41/00

[52] U.S. Cl. ..... 141/85; 141/197

[58] Field of Search ..... 137/224, 225; 141/4, 141/83, 85, 90, 95, 96, 114, 197, 329; 53/403, 52, 493

[56] References Cited

U.S. PATENT DOCUMENTS 1,769,941 7/1930 Bre Miller ..... 141/329 X 3,104,675 9/1963 Blenman ..... 141/197 X 3,922.977 1/1976 Ringler ..... 141/4 X 4,166,482 9/1979 Sanders ..... 141/85 X

*Primary Examiner*—Mark John Thronson

*Attorney, Agent, or Firm*—Douglas B. White

[57] ABSTRACT

An improved ball inflation apparatus is provided wherein inflation pressure is injected through a coaxial needle where sensed pressure is also passed to a dual diaphragm pressure sensing device which generates a control signal to terminate the inflation pressure flow at the proper inflation level.

6 Claims, 17 Drawing Figures

A
110
118
114
116

111
121
122
120
116
A 118
114
124

110

A-A

B-B

C-C

D-D

BALL INFLATION APPARATUS

BACKGROUND OF THE INVENTION

This invention relates generally to pressure limiting valves and more particularly to automatic pressure limiting apparatus which terminates fluid pressure flow on the attainment of a predetermined pressure within an object subjected to the pressure.

The control of inflation pressure has long been the subject of development both in conjunction with vehicle tires as well as for the inflation of other objects such as cushioning bags, containers, basketballs and footballs. Traditionally, this inflation process has been carried on by the human intervention method, whereby air is injected into the object to be inflated and periodic pressure checks are taken by an operator with a gauge. Automatic apparatus has been developed as described in the U.S. Patent issued to Kennedy, U.S. Pat. No. 3,026,916, where the injection of pressurized air for fixed intervals of time is used to achieve the desired inflation. In the Kennedy reference a vehicle tire is inflated for successive predetermined periods of time until a preset pressure is sensed and the successive operation interrupted. Another approach has been described by the U.S. Patent issued to Glendmand, U.S. Pat. No. 3,104,675, in which a fluid feed back passage is used to sense the inflation pressure and feed the pressure back to a diaphragm valve which closes and interrupts the inflation pressure conduits. The Glendmand concept, however, is not useful for the inflation of basketballs, footballs, and the like which require a small needle to inject the pressure.

In the present invention there is provided an improved pressure limiting and inflation apparatus in conjunction with a small coaxial needle providing fast and accurate inflation to predetermined pressures regardless of the beginning air volume in the object to be inflated.

Accordingly, the primary object of this invention is to provide an accurate inflation appparatus.

It is a further object of this invention to provide an inflation apparatus which operates in conjunction with an insertable needle for the inflation of basketballs and footballs and the like.

It is still a further object of this invention to provide an adjustable and controllable inflation apparatus.

Other objects and advantages of the invention will become apparent upon reading the following detailed description and upon reference to the drawings, in which.

Figure 1:
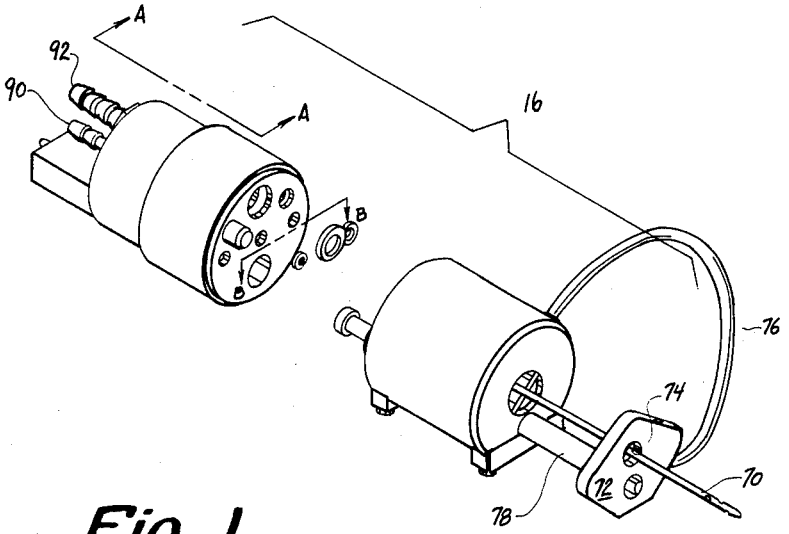
FIG. 1 is a perspective view of the ball inflation needle apparatus.
Figure 12:
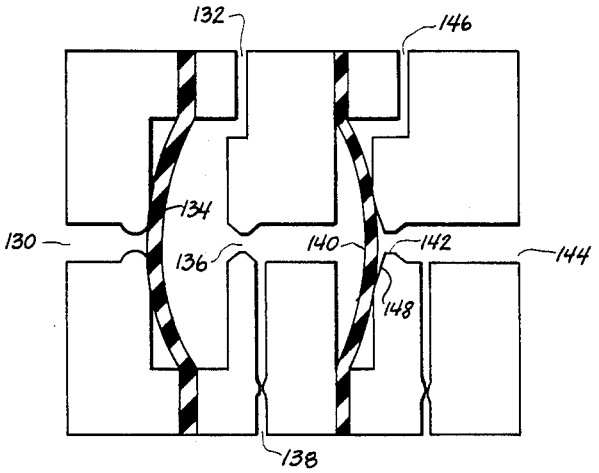
Figure 13:
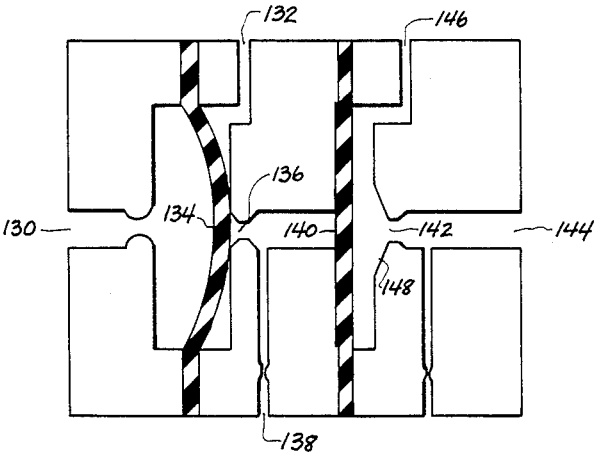
Figure 14:
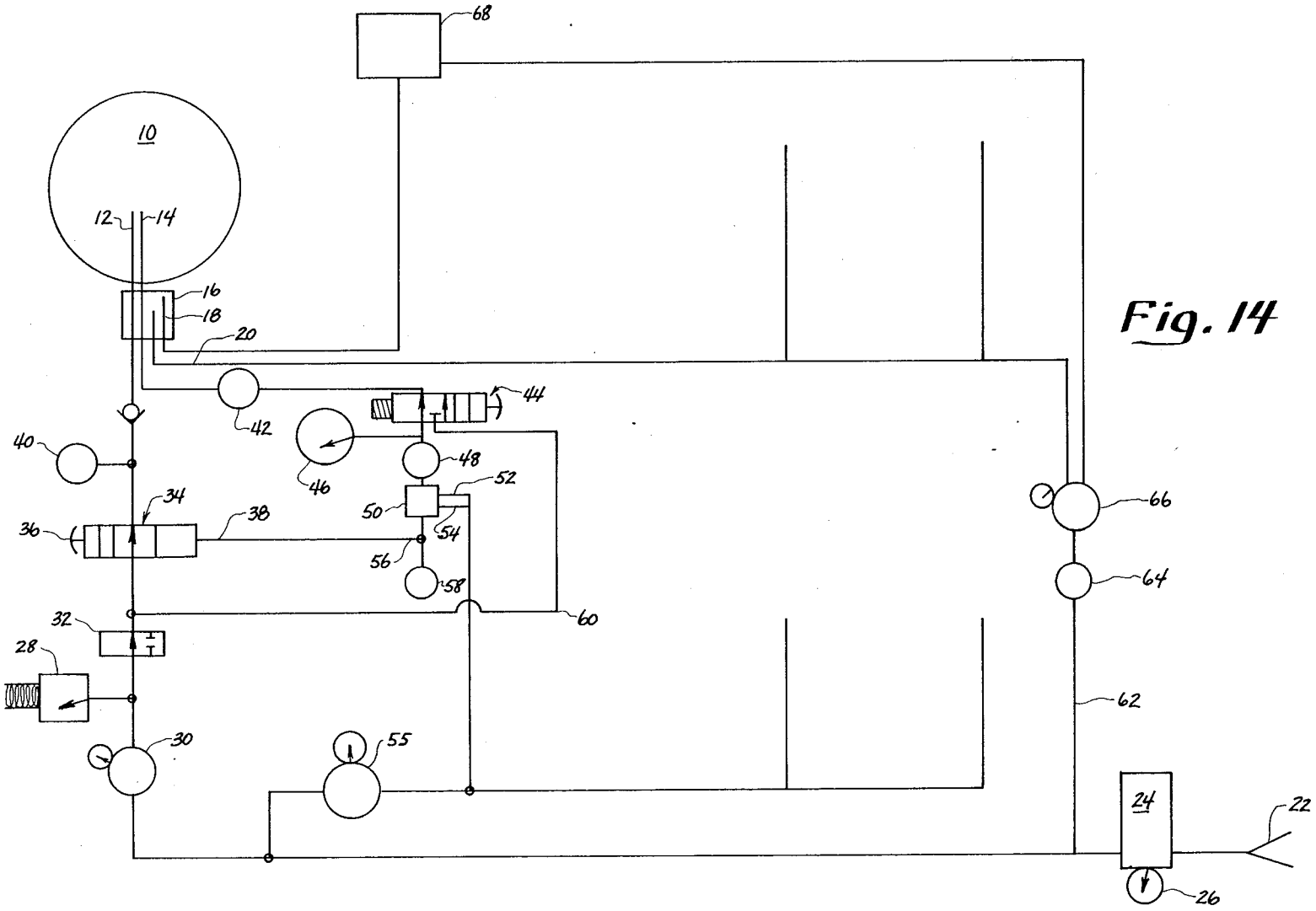

FIG. 11*a* through 11*d* are cross sectional views of FIG. 1;

FIG. 12 is a cross sectional view of the fluid pressure sensing and control device in a first mode;

FIG. 13 is a cross sectional view of the pressure sensing and control device in a second mode;

FIG. 14 is a schematic of the fluidic circuitry for the inflation control apparatus.

While the invention will be described in connection with a preferred embodiment, it will be understood that I do not intend to limit the invention to that embodiment. On the contrary I intend to cover all alternatives, modifications and equivalents as may be included within the spirit and scope of the invention as defined by the appended claims.

DESCRIPTION OF PREFERRED EMBODIMENT

Turning first to FIG. 14 there is shown a schematic of a fluidic circuit of the present invention. The inflatable object 10 is shown as a circular representation having located inside two fluidic orifices 12 and 14. A first orifice 12 provides pressurized fluids such as air to inflate the object 10, while the second orifice 14 senses the current pressure of the fluid within the object 10 for purposes of controlling the inflation pressure line. Holding both of these orifices for insertion into the inflatable object is a needle apparatus 16, shown schematically, and also shown holding a needle lubrication line 18, and lubrication actuator line 20 as will be more fully described below.

More particularly, pressure is applied by pressurized air hose or common fluidic pump at the inlet pressure line 22 that has a customary filter 24 and pressure gauge 26 for protection of the system. From there the pressure is fed past a protective relief valve 28 and the system regulator and pressure gauge 30 to an actuating ball valve 32. When the ball valve is opened, as shown, the system is in condition for operation. Pressure is fed to a pressure controlled valve 34 which, in operation, allows pressure to pass after being manually depressed at its actuator 36 and retains that position until actuated by a pressure control line 38 to shut the valve to its "off" position.

For indicating that the system is operating in the inflation mode there is provided a non electrical fluidic indicator 40, commonly known in the art, to sense the pressure in the line and provide a corresponding visual signal. Then after passing through a check valve, the fluid, under pressure, is passed into the inflating object 10 through the inflation needle apparatus 16 as will be more fully described below.

For sensing the pressure in the inflating object there is provided, within the needle apparatus, a sensing conduit 14. This conduit connects to the fluidic pressure present in the inflating object and passes same through the needle apparatus to a reservoir tank 42 and then through a purge line valve 44, a pressure indicating gauge 46, and a line filter 48 to a pressure sensing and controlling device 50. This device is shown schematically in FIG. 14 and in more detail in FIGS. 12 and 13 as will be more fully described below. Generally, a reference pressure, regulated by pressure regulator 55, is provided to the reference ports 52 and 54 of the sensing and controlling device 50 which senses the pressure on the sensing line and compares same to the reference pressure. When the sensed pressure exceeds the reference pressure a signaled output is provided at its output 56 which generates a visual signal in the pressure indicator 58 and the noperates to close the pressure control valve 34 on the inflation line.

To clean the sensing orifice of the needle apparatus there is provided a purge line 60 leading from the pressurized inflation line up to the purge valve 44. When this purge valve is manually depressed, pressure is injected directly through the sensing needle to clean out any dust particles which may have accumulated therein. Due to the small size of the needle and the environment under which this is operating, periodic purge is required for efficient operation. Automatic periodic purge is achieved whenever the needle is removed from the ball. The pressure built up in the reservoir tank 42 releases back through the needle to purge the sensing line, thereby eliminating frequent manual purges.

There is further provided in the needle apparatus a lubrication line 18 and a lubrication actuator line 20 for providing lubrication on the needle to prevent breakage and to facilitate the insertion of the needle into the object for inflation. More particularly, there is provided a pressurized line 62 leading from the inlet pressure line 22 through a filter 64 and regulator and pressure gauge 66. Pressure is then provided to an oil reservoir 68 which feeds oil under regulated pressure to the needle lubrication line 18. The lubricator actuation line is likewise fed with pressure through a regulator from the inlet pressure line and operates a plunger mechanism to lubricate the needle as will be described more fully below.

Figure 8:
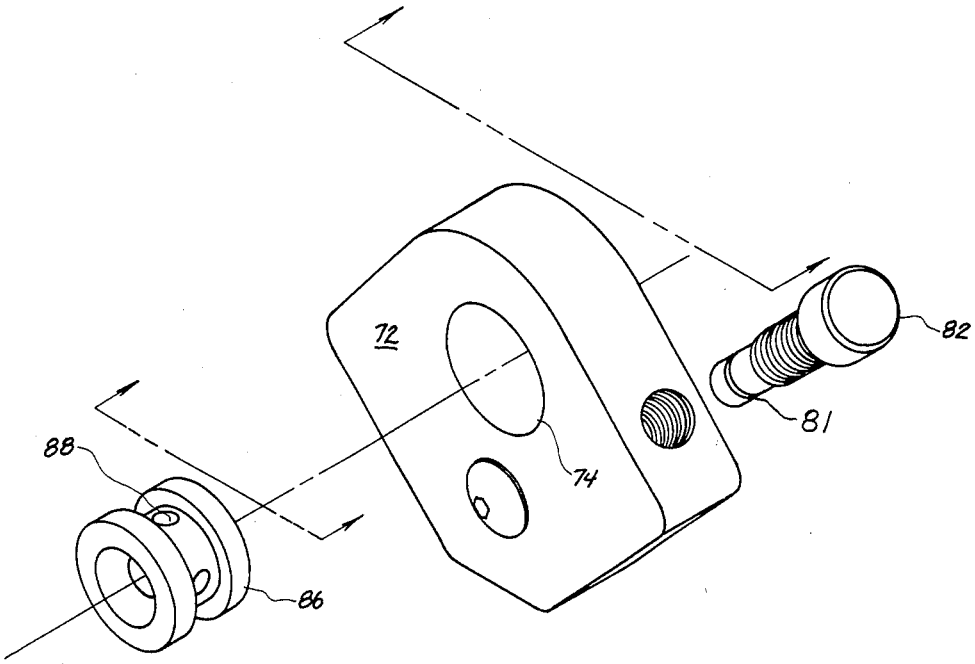
FIG. 8 is a perspective view of the needle lubrication assembly of FIG. 1.
Figure 9:
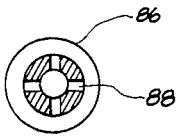
FIG. 9 is a cross sectional view of a member of the assembly of FIG. 8.
Figure 10:
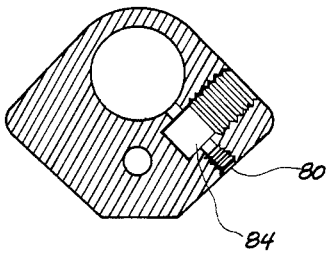
FIG. 10 is a cross sectional view of a portion of the assembly of FIG. 8.
Figure 11A:
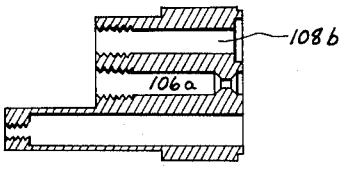
Figure 11B:
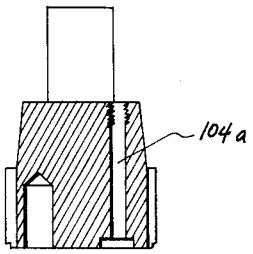
Figure 11C:
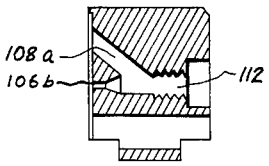
Figure 11D:
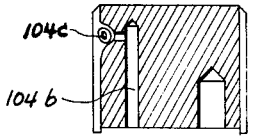

Turning back now to FIG. 1, there is shown the needle apparatus 16 of the present invention having a coaxial needle 70 arranged for insertion into the object to be inflated. Encompassing this needle, and mounted for reciprocal action along said needle to provide lubrication uniformally thereacross, is provided a lubrication member 72 having a needle encompassing hole 74 located thereon and having an oil feed line 76 made of flexible tubing feeding to the side thereof. To provide longitudinal motion there is provided air pressure to a cylinder 78 forcing the lubrication device 72 towards the end of the coaxial needle 70. During insertion manual pressure exceeds the cylinder pressure and the lubrication device is forced back away from the point of the needle thereby distributing oil through the needle encompassing hole about the coaxial needle. The lubrication fluid is fed through a side port 80 (FIG. 10) and metered therethrough by a precision groove 81 toward the tip of a threaded non adjustable control bolt 82 inserted into the oil passage at its junction 84 therewith. Oil passed therethrough contacts and envelops the oil distributing cylinder 86 and passes through the radial oil feed holes 88, most clearly shown in FIGS. 8 and 9, to flow to the coaxial needle.

Figure 2:
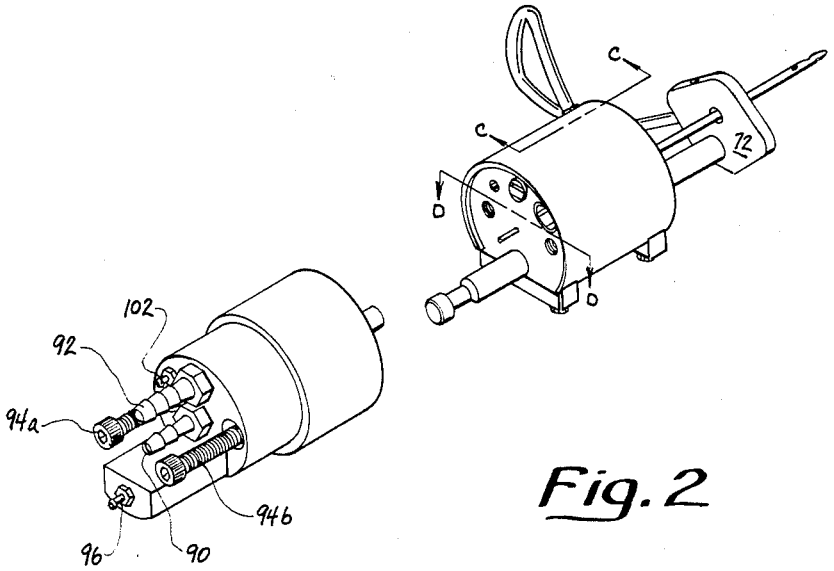
FIG. 2 is a perspective view of the apparatus of FIG. 1 of a different angle.

Returning now to FIGS. 1 and 2, there is shown the fluid pressure line attachment 92 for feeding the inflation air pressure and the sensing line attachment 90 for receiving the sensed air pressure in the inflated object. A pair of mounting bolts **94*a* and 94*b* is arranged on each side of the sectioned device to hold the two sections together, while at the base there is provided the lubrication actuator line attachment 96 for moving the lubrication member longitudinally on the needle. By providing a constant pressure at the actuator pressure attachment inlet, pressure is conveyed to the piston cylinder 78 actuator which maintains the constant force on the lubrication member 72**. This maintains the lubrication member at the protruding end of the needle until insertion in the inflatable object. During insertion the lubrication member is forced back away from the protruding point of the needle and, in this process, lubricates the needle while the needle is being inserted.

Providing the lubricating fluid to the lubrication member there is shown a fluid inlet attachment 102 (FIG. 2) and drilled passageways **104*a* and 104*b* (FIG. 11) protruding to the lubrication line 104*c* feeding the fluid to the lubrication member. Through this line lubrication is constantly provided and made available at the lubrication member 72** for even distribution about the needle.

In operation pressure is fed to the inflatable object through the pressure inlet 92 and conveyed via a drilled orifices **108*a* and 108*b* to the outer member of the coaxial needle in the space between the outer member and the inner member. The sensed pressure is fed through the inner member of the coaxial needle, and through drilled channels 106a and 106*b* in the needle apparatus, as shown most clearly in FIG. 11, to the pressure sensing outlet and conduit attachment 90 at the rear portion of the needle apparatus. It can now be seen that in operation, with a pressure line attached to the pressure inlet 92, a pressure sensing line attached to the pressure sensing outlet 90, constant pressure attached to the lubrication actuator inlet port 96, and lubricating fluid fed to the lubrication port 102**, the coaxial needle may be inserted into an inflatable object such as a basketball, being lubricated as it is inserted, and pressure forced through the outer coaxial member of the needle to inflate the object with the pressure of the object being sensed through the pressure sensing circuit. When the ball is inflated to proper pressure, the inflation process terminates and the needle apparatus may be extracted.

Turning again to FIG. 11, the drilled conduits for the fluid lines of the needle apparatus are more clearly shown. The inner member 110 of the coaxial needle extends from its outer protruding end into the main channel 112 and protrudes therethrough into the rear portion 106 of the needle apparatus. In so doing it is sealed from contact with the fill line pressure whereby pressurized fluid from the item being inflated is isolated from the fill line circuit. The fill line pressure is fed within the outer coaxial member 114 of the needle, within that space between the outer member and the inner member. The outer member, however, although protruding through the main orifice 112 in the same manner as the inner member, terminates prior to penetration of the space between the two sections of the needle apparatus. Consequently, the fill line pressure is forced through the chambers surrounding the needle and fed into the item being inflated from channels **108*a* and 108*b***.

Figures 3, 4, 5, 6, 7:
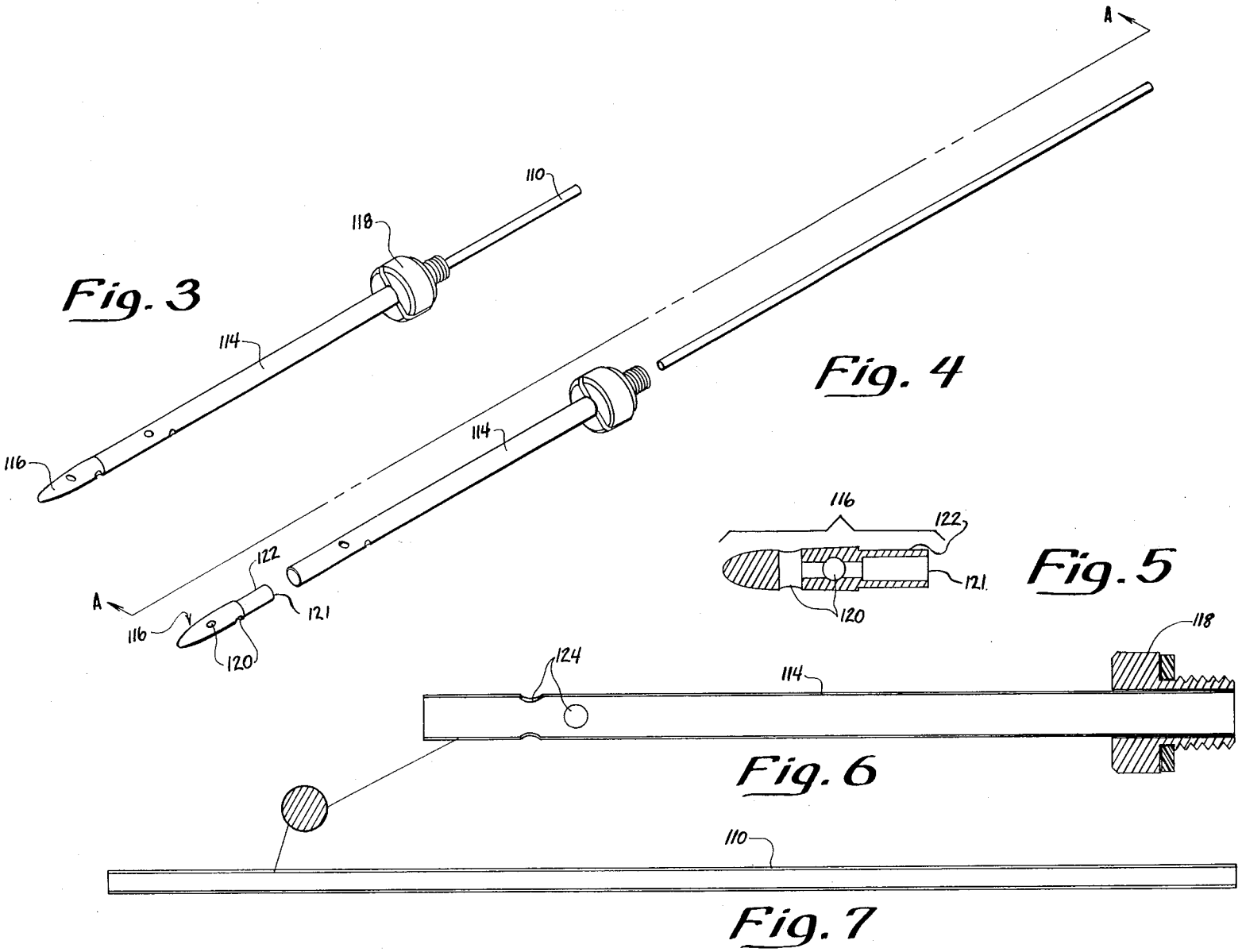
FIG. 3 is a perspective view of the inflation needle alone.
FIG. 4 is an exploded view of the inflation needle of FIG. 3.
FIG. 5 is a cross section of the needle tip of FIG. 4.
FIG. 6 is a cross sectional view of the intermediate member of the needle assembly of FIG. 4.
FIG. 7 is a cross sectional view of the rear member of the assembly of FIG. 4.

The composition of the coaxial needle is most clearly seen in FIGS. 3 through 7. FIG. 3 shows an assembled coaxial needle having an end portion 116 and outer coaxial member 114, an inner coaxial member 110 and an attachment plug 118. The needle tip, as seen in FIG. 5 is arranged to accept fluid from item being inflated in its inlet orifice 120 which in the preferred embodiment constitute through drilled holes arranged at right angles to each other, and pass same through its internal channel to orifices 121. The inner coaxial member 110 of FIG. 7 is arranged to fit snuggly within the orifice 121 of the needle tip while the outer diameter 122 of the needle tip is arranged to fit snuggly within the end portion of the outer coaxial member 114. This outer coaxial member, best seen in FIG. 6, has arranged thereon outlet holes 124, which in the preferred embodiment are through drilled holes arranged in perpendicular relation to each other, and which are set back from the end of said member sufficiently to avoid blockage of such holes by said tip member. When inserted into an inflatable object, these holes will be placed well within the object along with the sensing line holes 120 which will sense the ambient pressure within said object by feeding said pressure through said holes and along the inner portion of said inner coaxial member. Sealing this apparatus into the needle apparatus at the main chamber 112 is a sealing plug 118, best shown in FIGS. 3, 4, and 6.

The pressure sensing function as previously described is achieved by feeding the sensed pressure through the pressure sensitive conduit of the coaxial needle and through a conduit to the pressure sensing and control device shown in FIGS. 12 and 13. FIG. 12 shows the output of the pressure sensing and control device in an "off" condition (during this condition no pressure is provided through conduit 38 to switch the valve 34 off). The pressure being sensed is provided at the sensing input 130 while the reference pressure for the inflation, that is the pressure to which the inflatable object will be inflated, is provided at the inflation reference orifices 132 and 146. Mounted in a chamber between the sensing orifice 130 and the reference orifice 132 is a first diaphragm member 134 of flexible material arranged to seal against the outlet orifice 136 of the chamber when the sensed pressure exceeds the inflation reference pressure.

In FIG. 12 this first diaphragm 134 is shown in the position it adopts when the sensed pressure is below the inflation reference. Consequently, fluid flow is provided through the inflation reference orifice 132 and into the outlet orifice 136 and ultimately out the bleeder orifice 138. In this mode pressure is provided against the diaphragm 140 in the secondary chamber as shown in FIG. 12. With the pressure on the left side of this diaphragm in the secondary chamber exceeding that on the right side, the diaphragm is forced against the orifice 142. Consequently no fluid flow and no pressure is allowed to the outlet 144 of the secondary chamber. However, when the sensed pressure at orifice 130 exceeds the inflation reference pressure at orifice 132 (FIG. 13) the diaphragm in the primary chamber shuts off the fluid flow to the secondary chamber and no pressure is provided to the left side of the diaphragm in the secondary chamber. Consequently, the signal reference pressure provided at the second reference pressure input 146 forces the output diaphragm in the secondary chamber away from the orifice 142, and reference pressure is thereby provided to the output 144. (In this condition pressure at orifice 144 is fed via conduit 38 to switch the valve 34 to terminate the inflation process.)

With very low inflation reference and signal reference pressures, increased sensitivity must be achieved. This is provided with a contouring 148 of the output orifice to more accurately mate with the secondary diaphragm. Consequently, with low pressures no leakage will occur around the diaphragm and hence more accurate output signals will be achieved.

Accordingly, it can be seen that there has been shown and described herein an improved pressure limiting and inflation apparatus providing fast response time and accurate inflation regardless of the beginning air volume of the object to be inflated. Fluid under pressure is provided through a pressure control valve and through a coaxial needle to the object to be inflated. Air pressure is then returned, also through the coaxial needle, to a pressure sensing device which compares the pressure against a reference and closes the inflation pressure valve when the desired pressure is achieved.

I claim:

1. An apparatus for inflating a hollow object comprising:

(a) a reference source of fluidic pressure;

(b) a first fluid conduit connected to said reference pressure source for transmitting fluid under pressure to said object;

(c) a second fluid conduit arranged coaxially with said first fluid conduit for transmitting fluid under pressure from said object;

(d) pressure control means fluidically connected between said reference pressure source and said first fluid conduit for controlling pressure to said first fluid conduit in response to a pressure signal; and (e) sensing means fluidically connected to said second fluid conduit for sensing pressure therein and fluidically connected to said pressure control means for actuation thereof, comprising: a first chamber having a first flexible diaphragm mounted therein, and wherein sensed pressure is provided to one side of said first diaphragm and reference pressure is provided to the other side of said first diaphragm from said reference pressure source, and further comprising an outlet for passing fluid under pressure from said reference pressure source when said sensed pressure is less than said reference pressure, said outlet being arranged to be closed by said first diaphragm when said sensed pressure is greater than said reference pressure; and wherein said sensing means further comprises a second chamber having a flexible second diaphragm mounted therein and wherein pressure from the said outlet of said first chamber is provided to one side of said second diaphragm in said second chamber, and reference pressure is provided to the other side of said second diaphragm in said second chamber, and further comprising an outlet for passing fluid under pressure from said reference pressure source and arranged to be closed by said second diaphragm when said pressure from said outlet of said first chamber is greater than said reference pressure, whereby a pressure signal is generated to actuate said pressure control means when said sensed pressure exceeds said reference pressure.

2. The apparatus of claim 1 wherein said outlet of said second chamber comprises a contoured orifice formed to fit the curve of the second diaphragm when forced against said outlet of said second chamber by low pressure, whereby said outlet of said second chamber may be closed under low pressure.

3. The apparatus of claim 1 wherein said first and second fluid conduits comprise a coaxial needle having an inner tubular member arranged to transmit fluid under pressure between the extremities thereof, and an outer tubular member positioned coaxially with said inner tubular member to form a defined space between said inner and outer tubular members for transmitting fluid pressure between the extremities thereof.

4. The apparatus of claim 3 further comprising a termination member arranged to plug said defined space between said inner and outer tubular members and further comprising means to allow free flow of pressurized fluid to said inner tubular member, and further comprising means to allow free flow of fluid under pressure from said space between said inner and outer tubular members, proximate to but separate from said termination member.

5. The apparatus of claim 1 further comprising:

(a) a lubrication member mounted for reciprocal motion and arranged to envelop said first and second fluid conduits and distribute lubricating fluid on the exterior thereof; and (b) means for urging said lubrication member toward the extremity of said first and second fluid conduits.

6. The apparatus of claim 1 further comprising a reservoir fluidically connected between said second fluid conduit and said sensing means whereby ambient pressure from the inflatable object is captured to enable operation of said sensing means under low pressure and low volume conditions.

* * * * *